US007946965B2

(12) United States Patent
Carbonero

(10) Patent No.: US 7,946,965 B2
(45) Date of Patent: May 24, 2011

(54) HAND-HELD WALKING STILTS

(75) Inventor: Kurt K. Carbonero, Mt. Pleasant, SC (US)

(73) Assignee: Pull-Buoy, Inc., Sterling Heights, MI (US)

( * ) Notice: Subject to any disclaimer, the term of this patent is extended or adjusted under 35 U.S.C. 154(b) by 0 days.

(21) Appl. No.: 12/552,470

(22) Filed: Sep. 2, 2009

(65) Prior Publication Data

US 2010/0062910 A1 Mar. 11, 2010

Related U.S. Application Data

(60) Provisional application No. 61/094,678, filed on Sep. 5, 2008.

(51) Int. Cl.
*A63B 25/00* (2006.01)

(52) U.S. Cl. ..... 482/75

(58) Field of Classification Search ..... 482/75–76, 482/124–125, 129–130; 472/135; 446/23; 623/27–28

See application file for complete search history.

(56) References Cited

U.S. PATENT DOCUMENTS

| | | | | | |
|---|---|---|---|---|---|
| 1,529,421 | A * | 3/1925 | Dowdell | 482/75 |
| 1,984,114 | A * | 12/1934 | Collins | 482/76 |
| 2,160,722 | A * | 5/1939 | Cunningham | 482/79 |
| 2,242,748 | A * | 5/1941 | Fulwiler | 482/75 |
| 2,644,248 | A * | 7/1953 | Seligman | 36/7.5 |
| 2,646,282 | A * | 7/1953 | Ringman | 482/51 |
| 2,709,079 | A * | 5/1955 | Bubb et al. | 267/174 |
| 3,933,353 | A * | 1/1976 | Marsh | 482/51 |
| 5,391,134 | A * | 2/1995 | Heatwole | 482/146 |
| 5,980,351 | A * | 11/1999 | McCook | 446/26 |
| 7,357,766 | B2 * | 4/2008 | Langer et al. | 482/146 |
| 7,674,207 | B1 * | 3/2010 | Weaver et al. | 482/75 |
| 2007/0111867 | A1 * | 5/2007 | Pullaro | 482/121 |
| 2007/0117693 | A1 * | 5/2007 | Ilioi | 482/121 |

* cited by examiner

*Primary Examiner* — Fenn C Mathew

(74) *Attorney, Agent, or Firm* — Honigman Miller Schwartz and Cohn LLP

(57) ABSTRACT

A hand-held walking stilt comprising a base that contacts a walking surface, where the base has a foot stand to support a user's foot a set distance above the walking surface, where the foot stand defines an opening for a pole. The base also has at least one base flange extending into the opening. There is also a pole adapted to extend through the opening in the foot stand, and to extend above the base away from the walking surface, with the pole having at least one pole flange that interconnects with the base flange to hold the base and the pole together.

12 Claims, 4 Drawing Sheets

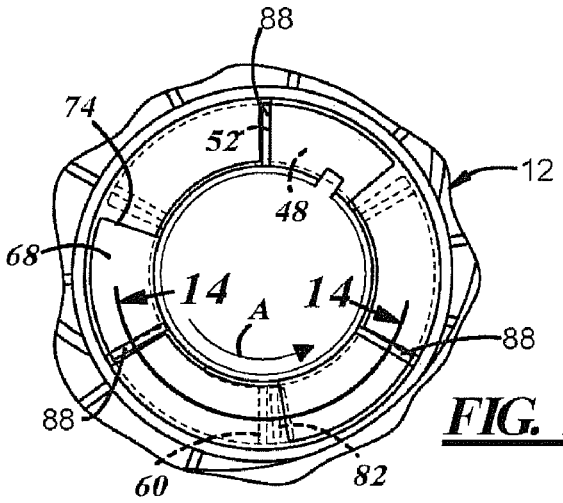
FIG. 13
FIG. 16
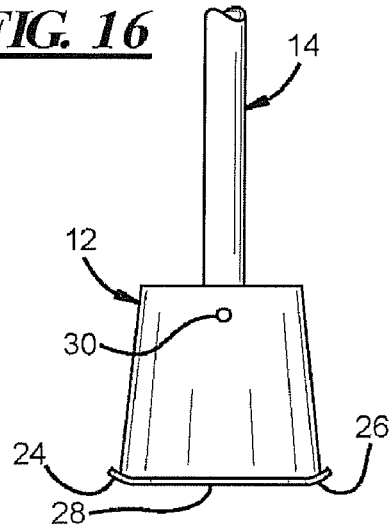
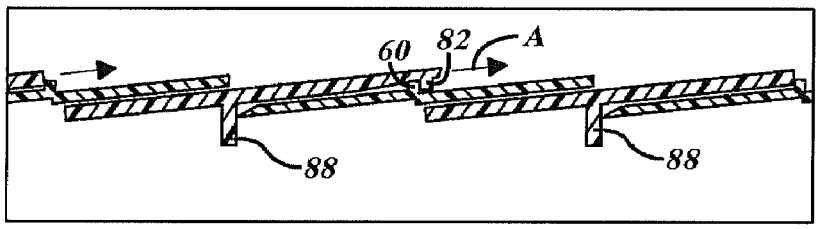
FIG. 14
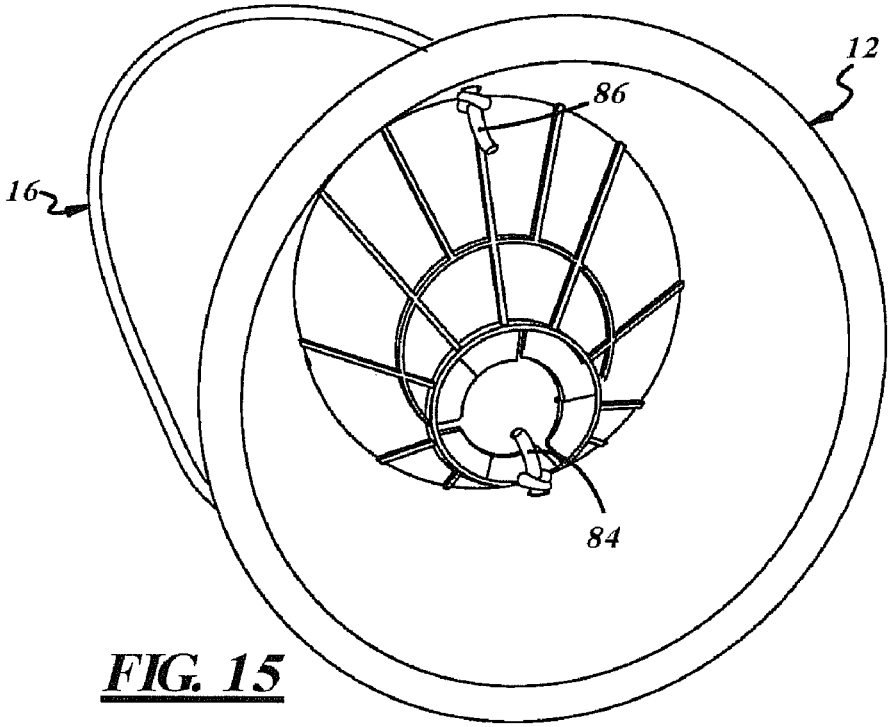
FIG. 15

HAND-HELD WALKING STILTS

This patent claims the benefit of the filing date of the following U.S. provisional patent application 61/094,678, filed Sep. 5, 2008.

TECHNICAL FIELD

The subject invention generally relates to hand-held walking stilts.

BACKGROUND

Hand-held walking stilts can be used in physical education classes as a way of improving balance and coordination. People may also use walking stilts for exercise, for recreation, and as a toy. Walking stilts are commonly categorized as "pole-type" stilts, in which a hand-pole extends from a foot-base; and as "rope-type" stilts, in which a hand-rope extends from a foot-base. The pole or the rope extending from the base can be gripped to help with walking and balance.

SUMMARY OF THE INVENTION

According to one version of the invention, there is a hand-held walking stilt comprising a base that contacts a walking surface. The base has a foot stand to support a user's foot a set distance above the walking surface, where the foot stand defines an opening for a pole. The base also has at least one base flange extending into the opening. There is also a pole adapted to extend through the opening in the foot stand, and to extend above the base away from the walking surface, with the pole having at least one pole flange that interconnects with the base flange to hold the base and the pole together.

According to another version of the invention, there is a method of assembling a hand-held walking stilt, the method comprising the steps of: providing a base that supports a user's foot above a walking surface and that has an opening with at least one base flange, and providing a pole that is grasped by a user's hand and that has at least one pole flange; inserting the pole into the opening such that the pole projects upward from the base; and twisting the pole in a first direction to overlap the base flange and the pole flange in order to connect the base and the pole together.

According to yet another version of the invention, there is a hand-held walking stilt comprising a base that contacts a walking surface, where the base has a foot stand to support a user's foot a predetermined distance above the walking surface, with the base defining an opening with an inner surface, and at least one helical base flange that extends from the inner surface and into the opening. There is also a pole adapted to be grasped by a user's hand that is receivable in the opening, with the pole having an end having at least one helical pole flange that extends from the end. The helical base flange is adapted to overlap with the helical pole flange to connect the pole and the base together in a threading manner when twisted in a first direction, and the helical base flange is adapted to separate from the helical pole flange in an un-threading manner when twisted in a second direction to disconnect the pole and the base from each other.

BRIEF DESCRIPTION OF THE DRAWINGS

The present invention will now be described, by way of example, with reference to the accompanying drawings, in which:

FIG. 13 is an enlarged view showing the pole and base flanges finally interconnected;

FIG. 14 is a section view taken along arrows 14-14 of FIG. 13;

FIG. 15 is a bottom perspective view of the base joined to a rope; and

FIG. 16 is a side view of an embodiment showing the contour of the bottom of the base.

DESCRIPTION OF THE PREFERRED EMBODIMENTS

Figure 3:
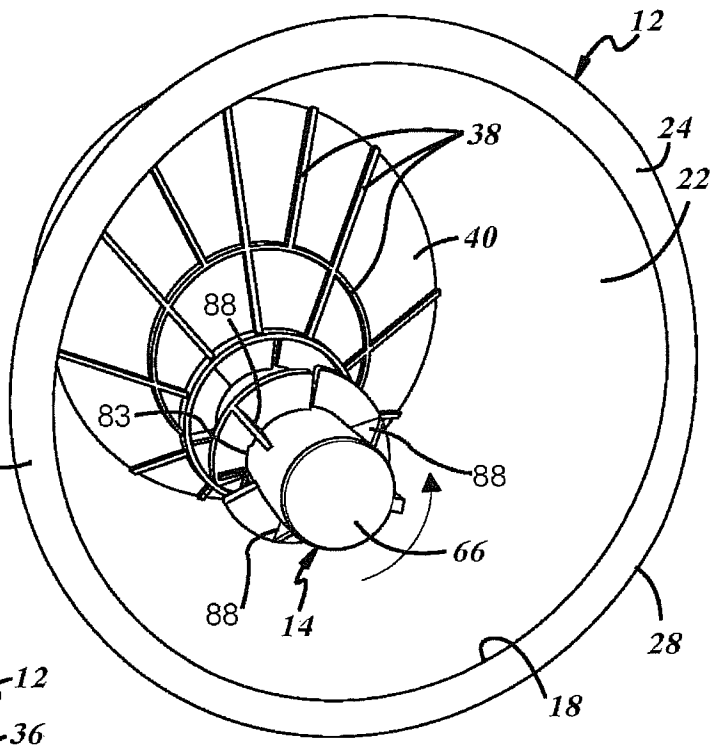
FIG. 3 is a bottom perspective view of the hand-held walking stilt.

Referring now to the drawings, FIGS. 1-15 show an example embodiment of a hand-held walking stilt generally shown at 10 that supports a user's foot and that can be grasped by a user's hand during use. The hand-held walking stilt 10 is designed for use as a pole-type stilt or a rope-type stilt. The hand-held walking stilt 10 includes a base generally indicated at 12, a pole generally indicated at 14 that is connectable with the base, and a rope generally indicated at 16 that is joinable to the base.

Figure 2:
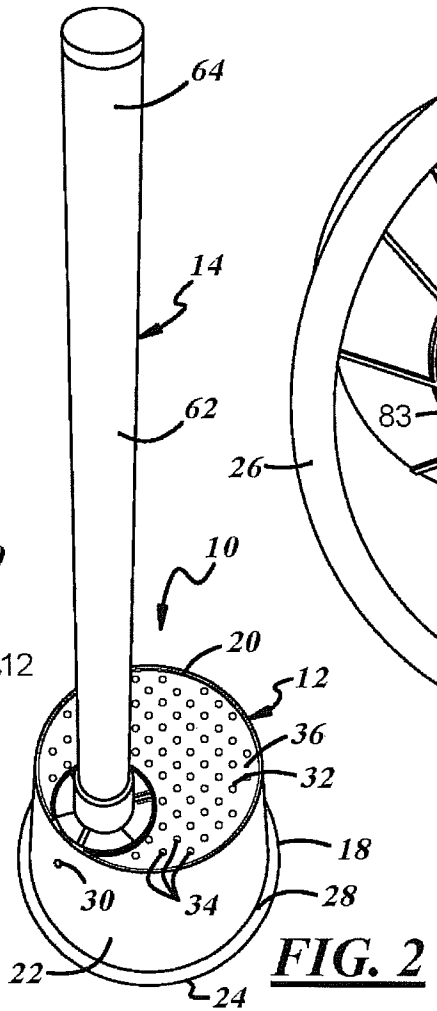
FIG. 2 is a top perspective view of an embodiment of a hand-held walking stilt having a base and a pole connected together.
Figure 1:
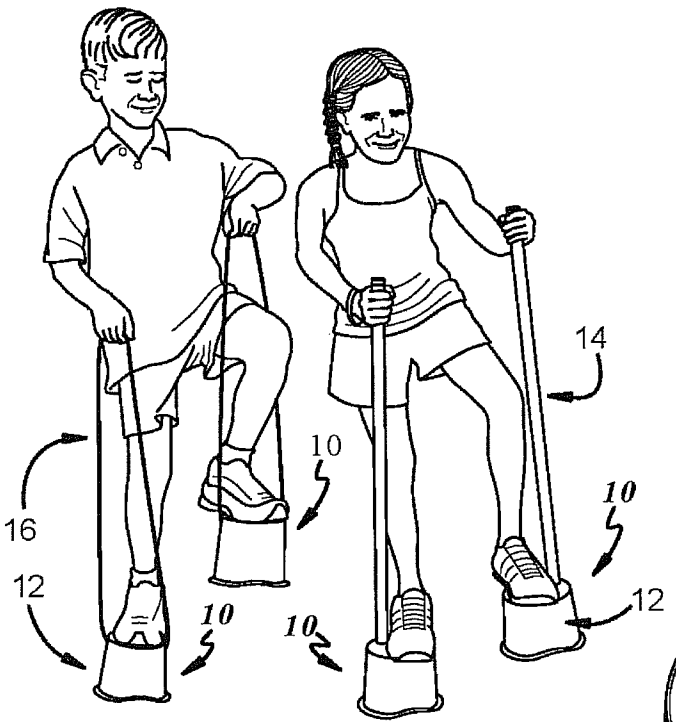
FIG. 1 shows students using example embodiments of hand-held walking stilts.
Figure 4:
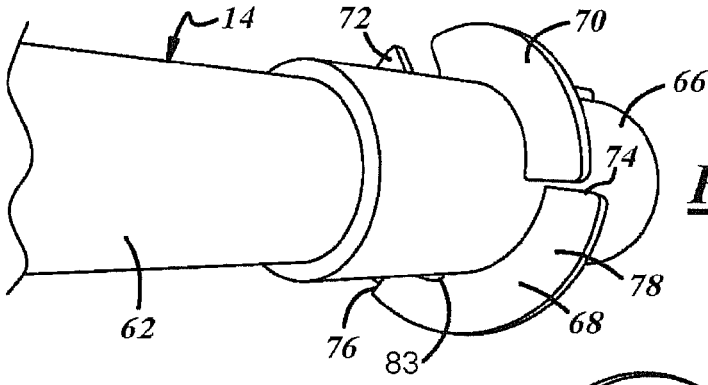
FIG. 4 is an enlarged top perspective view of an end of the pole.
Figure 5:
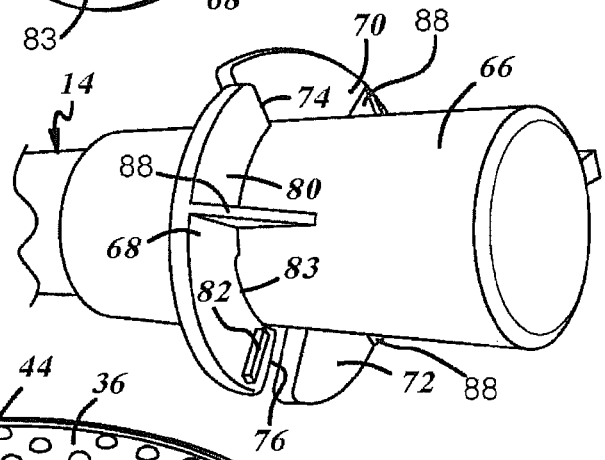
FIG. 5 is an enlarged bottom perspective view of the end of the pole.
Figure 6:
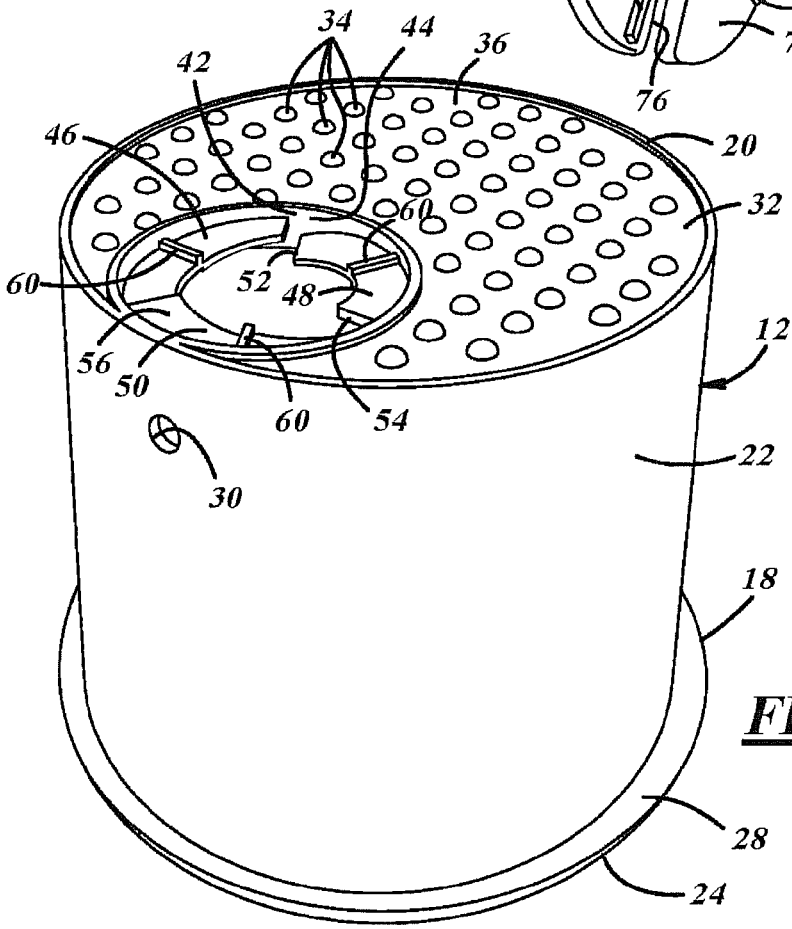
FIG. 6 is a perspective view of the base.
Figure 7:
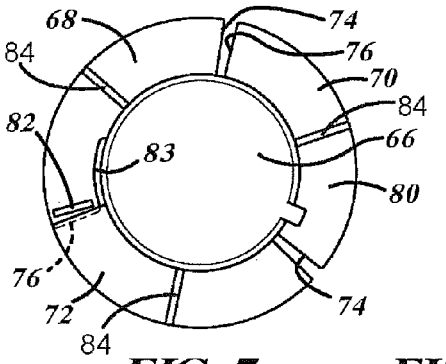
FIG. 7 is a bottom view of the pole showing pole flanges.

The base 12 directly contacts a walking surface during use, and supports a user's foot a predetermined or set distance above the walking surface. Referring to FIGS. 2, 3, and 6, the base 12 has a generally bucket-shape with an open-end 18 extending to a closed-end 20 via a circumferential wall 22. As shown best in FIG. 16, the open-end 18 has a leading raised section 24 and a trailing raised section 26 formed in a non-planar curled edge 28 of the open-end. The leading and trailing raised sections 24, 26 facilitate stepping over the walking surface by complementing a natural step from the leading, or toe end, to the trailing, or heel end. When at rest, the leading and trailing raised sections 24, 26 arc above a flat walking surface beneath. The circumferential wall 22 tapers radially toward the closed-end 20 such that the open-end 18 has a larger diameter than the closed-end, and such that a number of bases can be partially telescoped and stacked one-on-top-of-another to store the bases during nonuse and shipping. The circumferential wall 22 has a pair of holes 30 located opposite one another for receiving an unknotted rope end which can then be knotted to join the rope 16 to the base 12 (shown best in FIG. 15). Other embodiments can have a single hole or can have more than two holes.

A foot stand 32 is located at the closed-end 20 and serves as a platform for supporting a user's foot. Referring to FIGS. 3 and 6, on one side, the foot stand 32 has a number of traction beads 34 protruding from an exposed surface 36 for creating friction between the user's foot and the foot stand 32 to help prevent the user's foot from unintentionally sliding off of the foot stand. On the other side, a number of strengthening ribs 38 criss-cross each other on an unexposed surface 40 to help structurally support the foot stand 32 while carrying the weight of the user.

Figure 8:
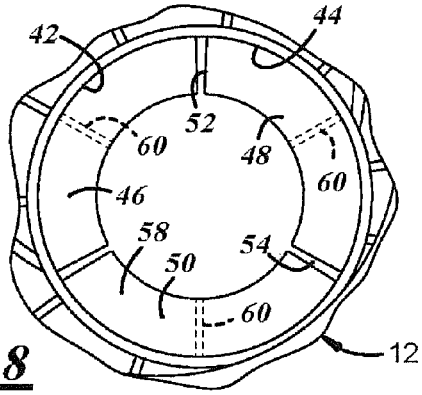
FIG. 8 is a bottom view of the base showing base flanges.

The base 12 further has an opening 42 located in the foot stand 32. Referring to FIGS. 6 and 8, the opening 42 is sized to receive the pole 14 and has an inner surface 44. One part of an interconnecting structure is located in the opening 42 and extends from the inner surface 44. The interconnecting structure provides a quick-connect and disconnect feature that allows the pole 14 to be coupled to the base 12 and then removed from the base as desired. The other part of the interconnecting structure is located on the pole 14 as will be described in more detail below. The interconnecting structure can come in various forms that temporarily secure the base 12 and the pole 14 together by one or more actions, including inserting and twisting. In the example shown, first, second, and third partially helical base flanges 46, 48, and 50 extend from the inner surface 44 and into the opening 42, and are spaced equally around the inner surface.

Each base flange has a first circumferential end 52 and a second circumferential end 54 that is inclined toward the foot stand 32 so that each base flange is ramped from the first circumferential end to the second circumferential end. Each base flange also has an upper surface 56 and a lower surface 58, and each upper surface has a base rib 60 located about midway between the circumferential ends and protruding axially from the upper surface. It should be appreciated that other interconnecting structures are possible that have not been shown or described. For example, a single helical base flange may extend around the inner surface 44, a pair of partially helical base flanges may extend around the inner surface, and more than three partially helical base flanges may extend around the inner surface. Moreover, the base flanges need not necessarily be helical and instead could be axially staggered on the inner surface 44 with respect to each other.

The pole 14 is connectible with and disconnectible from the base 12 and, when connected, extends above the base and away from the walking surface. Referring to FIGS. 2, 4, 5, and 7, the pole 14 is designed to be grasped by a user's hand, but could have other designs including one with shoulder rests, for example. The pole 14 has an elongated body 62 that extends from a first end 64 to a second end 66. The other part of the interconnecting structure is located near the second end 66 and complements the construction of the interconnecting structure located on the base 12. In this example, a first, second, and third partially helical pole flange 68, 70, and 72 protrude away from the body 62 and are spaced equally around the body. A flange support 88 supports each flange 68, 70, 72.

Each pole flange has a first circumferential end 74 and a second circumferential end 76 that is inclined toward the first end 64 so that each pole flange is ramped from the first circumferential end to the second circumferential end. Each pole flange also has an upper surface 78 and a lower surface 80. In this example, the first pole flange 68 has a pole rib 82 located near the second circumferential end 76 and protruding from the lower surface 80. The second circumferential end 76 of the first pole flange 68 extends farther than the other second circumferential ends so that it slightly overlaps the neighboring circumferential end of the third pole flange 72. The first pole flange 68 also has a space 83 formed between the body 62 and the first pole flange to allow the second circumferential end 76 to flex during connection. In other examples, one or both of the other pole flanges may also have a pole rib, may have a recess, or may have a combination thereof. Like the base flanges, other interconnecting structures for the pole flanges are possible that have not been shown or described.

The rope 16 can be joined with and unjoined from the base 12 as desired. Referring to FIG. 15, the robe 16 has a first and second free end 84, 86 that can be inserted into the holes 30 and knotted for joining the rope to the base 12. To unjoin the rope 16 and base 12, the free ends can be unknotted and pulled out of the holes 30. The rope can be actual woven rope or an elongated piece of plastic that is extruded in solid or tube form.

Figure 9:
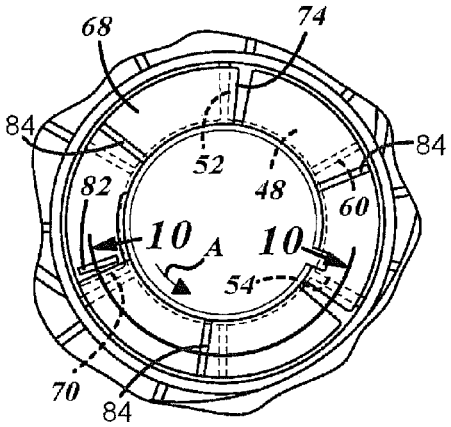
FIG. 9 is an enlarged view showing the pole and base flanges initially interconnected.
Figure 11:
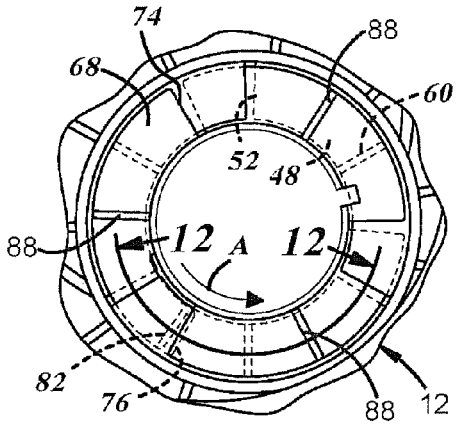
FIG. 11 is an enlarged view showing the pole and base flanges interconnected about midway.
Figure 10:
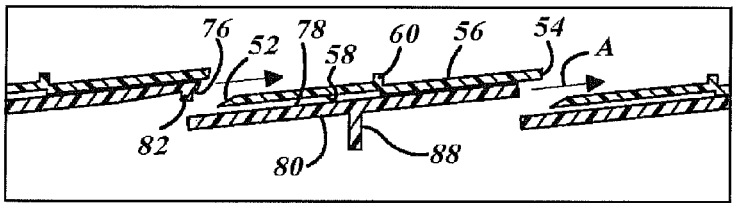
FIG. 10 is a section view taken along arrows 10-10 of FIG. 9.
Figure 12:
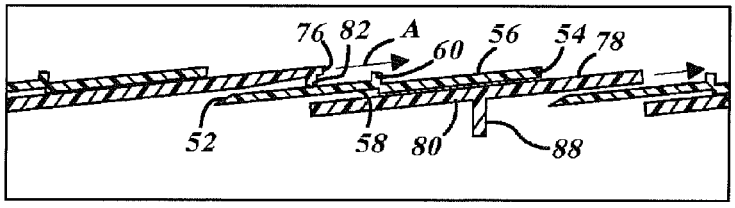
FIG. 12 is a section view taken along arrows 12-12 of FIG. 11.

In use, the hand-held walking stilt 10 can be interchangeably configured to function as a pole-type stilt or a rope-type stilt. Beginning with the base 12 by itself, to connect the pole 14, the first end 64 of the pole is inserted through the open-end 18 and then through the opening 42. The pole 14 is advanced through the opening 42 until the pole flanges and the base flanges confront one another as best shown in FIG. 3. The pole 14 is then twisted in a first direction A in a threading manner such that the pole flanges overlap and lock with the base flanges. Referring to FIGS. 9 and 10, the second circumferential ends 76 of each pole flange initially engage the first circumferential ends 52 of each base flange when the upper surfaces 78 of each pole flange lay against the lower surfaces 58 of each base flange. Referring to FIGS. 11 and 12, as twisting progresses, the lower surfaces 80 of each pole flange ride over the upper surfaces 56 of each base flange. The pole and base flanges lay on top of one another in an overlapping arrangement. Referring to FIGS. 13 and 14, when finally positioned the pole rib 82 flexes and snaps over the base rib 60 and is caught thereby, thus preventing twisting in a second and opposite direction and temporarily coupling the pole 14 and base 12 together. The pole and base flanges' overlapping arrangement prevents the pole 14 from being pushed or pulled out of the opening 42. To disconnect the pole 14, the pole is twisted in the second direction in reverse-threading manner and the pole rib 82 is again snapped over the base rib 60. The pole 14 is twisted until the pole and base flanges are no longer overlapped and the pole is reversed out of the opening 42. Whether the pole 14 is connected or disconnected, the rope 16 can be joined to the base 12 as described above. The construction and location of the interconnecting structure permits stacking of a number of bases without interference.

The invention has been described in an illustrative manner, and it is to be understood that the terminology that has been used is intended to be in the nature of words of description rather than of limitation.

Obviously, many modifications and variations of the present invention are possible in light of the above teachings. Therefore, it is to be understood that within the scope of the appended claims the invention may be practiced otherwise than as specifically described. Moreover, the reference numerals are merely for convenience and are not intended to be in any way limiting.

I claim:

1. A hand-held walking stilt, comprising:

a base that contacts a walking surface, the base having a foot stand to support a user's foot a set distance above the walking surface, where the foot stand defines an opening for a pole, the base also having at least one base flange extending into the opening, the at least one base flange having a base flange surface defining at least one base retention feature extending away from the base flange surface; and a pole adapted to extend through the opening in the foot stand, and to extend above the base away from the walking surface, the pole having at least one pole flange that interconnects with the at least one base flange to hold the base and the pole together, the at least one pole flange defining a pole flange surface opposed to the base flange surface and having at least one pole retention feature extending away from the pole flange surface;

wherein the at least one base retention feature and the at least one pole retention feature are adapted to engage each other during interconnection of corresponding base and pole flanges to secure the base and the pole together.

2. The hand-held walking stilt of claim 1 wherein the base defines at least one rope hole, with the stilt further comprising a rope that is joined to the base through the rope hole, where the rope has a grip portion remote from the base that is adapted to be grasped by the user's hand.

3. The hand-held walking stilt of claim 1 wherein the pole has an end, and the pole flange is located at the end.

4. The hand-held walking stilt of claim 1 wherein the pole flange is disposed in helical fashion around at least part of the pole, and the base flange is disposed in helical fashion around at least part of the opening whereby the pole flange and the base flange are adapted to mate in a threading relationship to connect the base and the pole together selectively by twisting the pole in a first direction to connect the pole to the base, and to twist in a second direction to disconnect the pole from the base.

5. The hand-held walking stilt of claim 1 wherein the base has a plurality of base flanges that are spaced around and extend into the opening, and wherein the pole has a plurality of pole flanges that are spaced around the end.

6. The hand-held walking stilt of claim 1 wherein the at least one base retention feature comprises a base rib that protrudes from the base flange surface, and wherein the at least one pole retention feature comprises a pole rib that protrudes from the pole flange surface and that is adapted to abut against the base rib to secure the base and the pole together.

7. The hand-held walking stilt of claim 1 wherein the pole includes a flange support disposed between the pole and the pole flange to provide support for the pole flange.

8. A hand-held walking stilt, comprising:

a base that contacts a walking surface, the base having a foot stand to support a user's foot a set distance above the walking surface, where the foot stand defines an opening for a pole, the base also having at least one base flange extending into the opening; and a pole adapted to extend through the opening in the foot stand, and to extend above the base away from the walking surface, the pole having at least one pole flange that interconnects with the base flange to hold the base and the pole together;

wherein the base has a generally bucket-shape with an open-end and a closed-end, the foot stand is located at the closed-end, and the open-end terminates at an edge that has at least one raised section to facilitate walking over the walking surface.

9. A hand-held walking stilt, comprising:

a base that contacts a walking surface, the base having a foot stand to support a user's foot a set distance above the walking surface, where the foot stand defines an opening for a pole, the base also having at least one base flange extending into the opening; and a pole adapted to extend through the opening in the foot stand, and to extend above the base away from the walking surface, the pole having at least one pole flange that interconnects with the base flange to hold the base and the pole together;

wherein the base has a generally bucket-shape with an open-end and a closed-end, the foot stand is located at the closed-end, and the foot stand includes a plurality of traction beads to provide traction for the user's foot and includes a plurality of strengthening ribs to help support the foot stand.

10. A hand-held walking stilt, comprising:

a base that contacts a walking surface, the base having a foot stand to support a user's foot a predetermined distance above the walking surface, with the base defining an opening with an inner surface, and at least one helical base flange that extends from the inner surface and into the opening, the at least one base flange having a base flange surface defining at least one base retention feature extending away from the base flange surface;

a pole adapted to be grasped by a user's hand and that is receivable in the opening, the pole having an end with at least one helical pole flange that extends from the end, the at least one pole flange defining a pole flange surface opposed to the base flange surface and having at least one pole retention feature extending away from the pole flange surface;

wherein, the helical base flange is adapted to overlap with the helical pole flange to connect the pole and the base together in a threading manner when twisted in a first direction, and the helical base flange is adapted to separate from the helical pole flange in an un-threading manner when twisted in a second direction to disconnect the pole and the base from each other; and wherein the at least one base retention feature and the at least one pole retention feature are adapted to engage each other during interconnection of corresponding base and pole flanges to secure the base and the pole together.

11. The hand-held walking stilt of claim 10 wherein the at least one base flange surface comprises a base rib that protrudes from the base flange surface, and wherein the at least one pole flange surface comprises a pole rib that protrudes from the pole flange surface and that abuts against the base rib when the pole is twisted in the first direction to secure the base and the pole together.

12. A hand-held walking stilt, comprising:

a base that contacts a walking surface, the base having a foot stand to support a user's foot a predetermined distance above the walking surface, with the base defining an opening with an inner surface, and at least one helical base flange that extends from the inner surface and into the opening; and a pole adapted to be grasped by a user's hand and that is receivable in the opening, the pole having an end with at least one helical pole flange that extends from the end;

wherein, the helical base flange is adapted to overlap with the helical pole flange to connect the pole and the base together in a threading manner when twisted in a first direction, and the helical base flange is adapted to separate from the helical pole flange in an un-threading manner when twisted in a second direction to disconnect the pole and the base from each other; and wherein the base has a bucket shape with an open end and a closed end, the open end terminates at an edge that has at least one raised section to facilitate walking over the walking surface, the foot stand is located at the closed end, and includes a plurality of traction beads to provide fraction for the user's foot, and further includes a plurality of strengthening ribs to help support the foot stand.

* * * * *